US005440471A

United States Patent [19]

Zadeh

[11] Patent Number: 5,440,471

[45] Date of Patent: Aug. 8, 1995

[54] FLORESCENT LIGHT FIXTURE ASSEMBLY

[75] Inventor: Rohollah E. Zadeh, Los Angeles, Calif.

[73] Assignee: Amp Plus, Inc., Culver City, Calif.

[21] Appl. No.: 254,378

[22] Filed: Jun. 6, 1994

[51] Int. Cl.[6] ..... F21S 3/021

[52] U.S. Cl. ..... 362/365; 362/147; 362/221; 362/364

[58] Field of Search ..... 362/147, 260, 366, 364, 362/365, 396, 404, 221, 279, 403

[56] References Cited

U.S. PATENT DOCUMENTS 5,193,903 3/1993 Anisfield ..... 362/260

FOREIGN PATENT DOCUMENTS 2653858 5/1991 France ..... 362/404

4016531 11/1991 Germany ..... 362/147

312104 12/1990 Japan ..... 362/260

*Primary Examiner*—Ira S. Lazarus

*Assistant Examiner*—Y. Quach

*Attorney, Agent, or Firm*—Beehler & Pavitt

[57] ABSTRACT

A florescent lamp fixture for retrofitting in a cylindrical ceiling or wall-type housing designed to support an incandescent lamp providing elimination through the open end of the housing, the fixture being formed of a transverse insulated plate securable within the housing by at least three radiating spring elements, the plate serving to support a transformer on its upper side and a plug-in socket to receive, through an opening in the plate, one or more florescent lamps to extend from the opposite lower side of the plate. Wiring between the transformer and socket is provided to plug the fixture into the socket for the replaced incandescent lamp.

2 Claims, 3 Drawing Sheets

FLORESCENT LIGHT FIXTURE ASSEMBLY

FIELD OF THE INVENTION

This invention relates generally to the field of light fixtures and particularly to florescent light fixtures which are designed for installation in an aperture in a ceiling to project flushly with the plane of the ceiling and to replace originally installed incandescent lamps.

BACKGROUND OF THE INVENTION

In recent years, it has generally been accepted that ceiling lighting fixtures should, at their light projecting ends, coincide flushly with the plane of the ceiling in which the lighting fixture is installed. From a safety standpoint, unless the lighting fixture is of the elongated panel type, a circular aperture is cut or otherwise provided in the ceiling and a rigid, usually metallic cylindrical housing is pushed upwardly through the aperture and secured in some manner by a lateral support means to joists or beams supporting the ceiling. Within this housing, a lamp socket for an incandescent bulb is ordinarily provided which socket may be connected by BX cable or other wiring through the wall of the housing to the edifice lighting circuit. In some cases, a lamp socket may be loosely disposed in the upper part of the housing to receive an incandescent light bulb inserted through a reflector disposed in the lower part of the housing. In other cases, some type of metallic bridge has been secured across the inside of the upper part of the housing where the socket may be fixedly or pivotally mounted.

In recent years it has become desirable to replace such standard incandescent bulbs with compact florescent lamps. By such replacements, less energy is required and the lighted fixtures dispense substantially less heat. However, replacing incandescent bulbs which screw into a conventional socket disposed loosely or fixedly within a housing, is not a simple matter since a florescent lamp requires a special plug-in socket different from the threaded socket for an incandescent lamp, and a transformer. These must be properly supported and cannot be left to dangle within the housing. Additionally, for the most effective heating, the elongated florescent lamp or lamps should be disposed close to the axis of the housing and its reflector.

Thus, retrofitting recessed incandescent lamp fixtures with florescent lamps has presented such problems that it has been considered simpler to remove the entire housing and rebuild the inside of the fixture to install what is needed for a florescent lamp replacement of an incandescent lamp fixture.

SUMMARY OF THE INVENTION

It is an object of the present invention, to provide a group of parts which could comprise a kit, which may readily be assembled as a unit and inserted in a recessed housing to replace an incandescent lamp fixture threaded into a conventional screw type socket.

This object of the invention is accomplished by first removing the incandescent light bulb and providing a mounting plate with a plurality (preferably at least three) spring clips extending laterally from the mounting plate to contact the inside of the wall of the cylindrical housing. These clips are yieldable to the extent of enabling the mounting plate or panel to be axially inserted into the cylindrical housing where the plate is suspended by the clips pressing against the housing wall, but may be removed therefrom. The florescent lamp socket and required transformer are mounted on the upper side of the mounting plate to face the closed end of the housing, but with the lamp socket having its lamp receiving recess facing downwardly and accessible through an aperture in the plate which aperture is centered to lie in cylindrical housing axis. There is also removably mounted on the underside of the plate a reflector housing to extend downwardly coaxially with the cylindrical housing to the plane of the ceiling where the cylindrical housing wall also terminates.

The entire assembly of the spring supported plate with the transformer and florescent lamp socket on the top side and the plugged-in lamp and reflector may be conveniently put together outside of the housing with wiring including two wires extending into a screw-in plug which may be threaded into the existing incandescent lamp socket.

To retrofit a fixture having an incandescent bulb with the assembly of the present invention, one first unscrews the bulb from the socket and removes the reflector surrounding the bulb. The plug above the plate is then screwed into the lamp socket and the entire assembly is pushed up axially into the housing where it is held in place by the spring clips and turned with the mounting ring.

Access to the entire unit may easily be obtained by simply reaching in the ceiling opening, grasping the reflector and pulling it downwardly and outwardly against the yielding of the spring clips. In this manner, ready access may be had to both the lamp socket and the transformer on the plate, as well as to remainder of the wiring circuit.

It is also a feature of the invention to provide a narrow outwardly extending flange at the bottom end of the reflector and a mounting ring (preferably of plastic) having an inside annular recess. This mounting ring is disposed around the reflector before it is secured to the mounting plate and serves to trim the aperture into which the cylindrical housing has been inserted and secured, and also to seat the bottom of the reflector when the entire unit has been pushed into the housing.

DESCRIPTION OF THE DRAWINGS

FIG. 1(*a*) is an enlarged detail showing the manner in which the trim ring numbered 50 is assembled, with the lower end of the reflector housing, as shown in FIG. 1 and held in the ceiling opening.

DESCRIPTION OF THE PREFERRED EMBODIMENT

Figure 1:
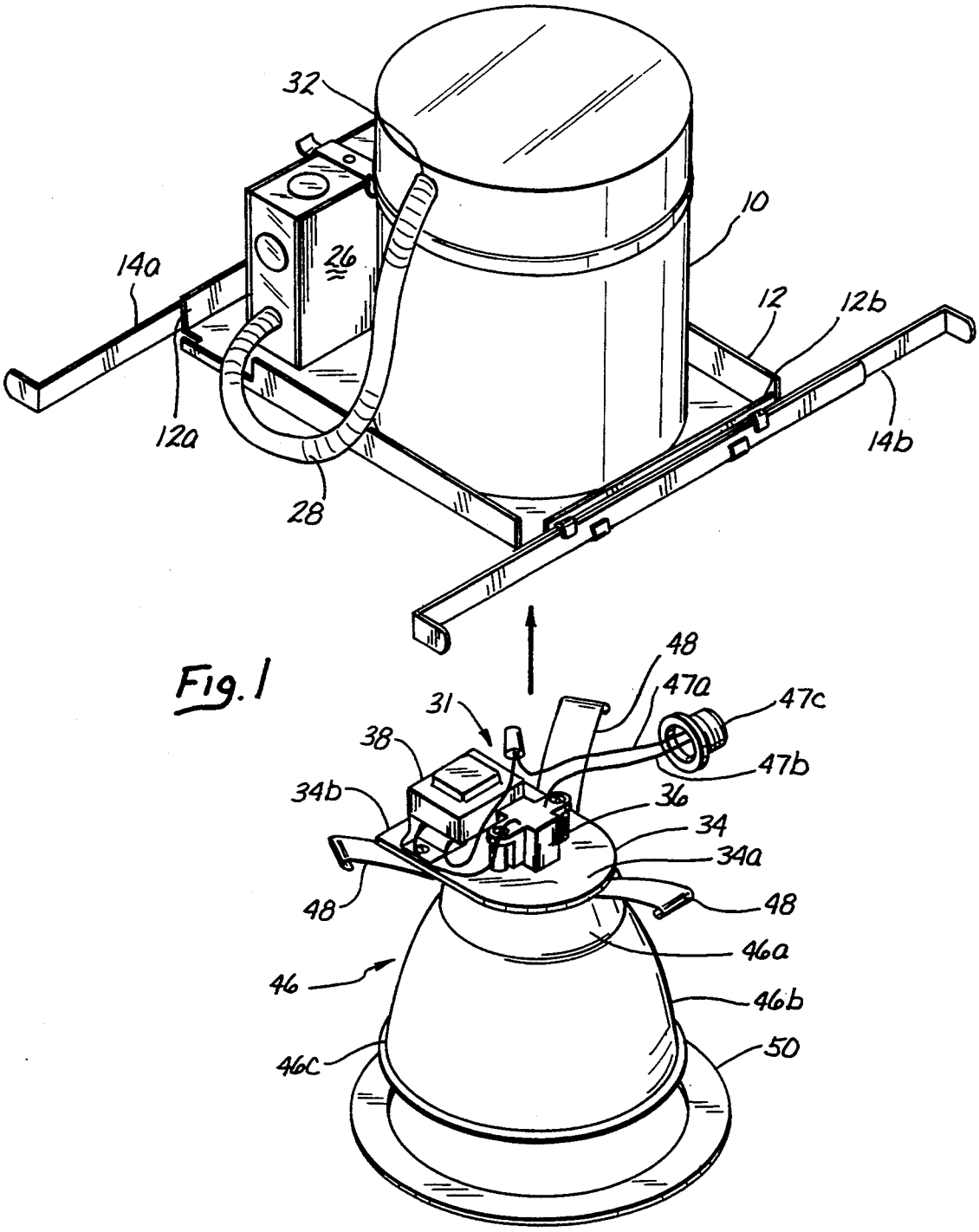
FIG. 1 is a perspective view of a typical housing adapted for mounting on joints supporting a ceiling and showing also in perspective the fixture of the present invention when removed from the housing.

In typical installations of circular flush lighting in a ceiling, a housing 10 is mounted on a metal tray 12, the ends 12*a* and 12*b* of which may be secured to horizontal support members 14*a*, 14*b*, respectively, attached to joints 16*a*, 16*b* (FIG. 2). The housing 10 may be comprised of a lower cylindrical wall 10*a* and an upper cylindrical cap 10*b*, both of which may be force-fitted together, as at 10*c*. Lower cylindrical wall 10*a* terminates at its lower end 10*a'*in the plane of the ceiling panels or tiles 18 when the housing 10 is mounted in the aperture 20. Electrical wiring 22 may be brought into the housing space 24 from a circuit box 26 via an insulated cable 28 through a fixture 30 secured in an orifice 32 in the upper cylindrical cap 10*b* of the housing. In a conventional incandescent lamp installation, an incandescent lamp 43 is screwed into a socket 52 and projects downwardly through a reflector housing 45 which is secured in some manner within the aperture 20.

What has been described thus far constitutes no part of the present invention.

The present invention provides an effective and easily installable assembly 31 for replacing an incandescent lamp fixture with a florescent unit 31. The assembly 31 is constructed about a rigid base or plate 34 of a dialetric or other insulated material. While this plate 34 could assume a number of different shapes, it is preferred that one end 34*a* be semi-circular with its other end 34*b*, a rectangular extension. This preferred shaping is to enable a plug-in light socket 36 to be mounted at the center of the semi-circular portion 34*a*; while the rectangular extension end 34*b* extends further in a direction from the axis of the semi-circular portion 34*a* to provide an area on which a transformer 38 may be mounted. Where the florescent light socket 36 is mounted, a central aperture 40 is provided in the plate 34 so that the base 42 of a florescent lamp 44 may be plugged into the socket 36 through the aperture 40. A reflector 46 is secured by bolts 37*a* and nuts 37*b* to the underside of the plate 34 and the socket 36.

The entire unit 31 shown in the lower part of FIG. 1 may be resiliently mountable within the lower portion 10*a* of the cylindrical housing 10 by means of a plurality of spring clips 48, also secured to the underside of the plate 34, preferably spaced apart from each other equilaterally.

The reflector 46 may be formed in two sections 46*a* and 46*b* joined to each other. As may be seen, the walls of the upper section 46*a* are almost frusto-conical, while the wall of the lower section 46*b* diverges in a domed manner with its lower edge being flanged outwardly at 46*c* to a diametric dimension only slightly less than that of the diameter of the bottom opening of the lower section 10*a* of the cylindrical housing 10.

For the purpose of trimming and better securing the lower section of the reflector 46 in the lower housing section 10*a* and the ceiling opening 20, a ring 50 is provided with an annular recess 50*a* on its underside into which the flange 46*c* may seat.

Figure 2A:
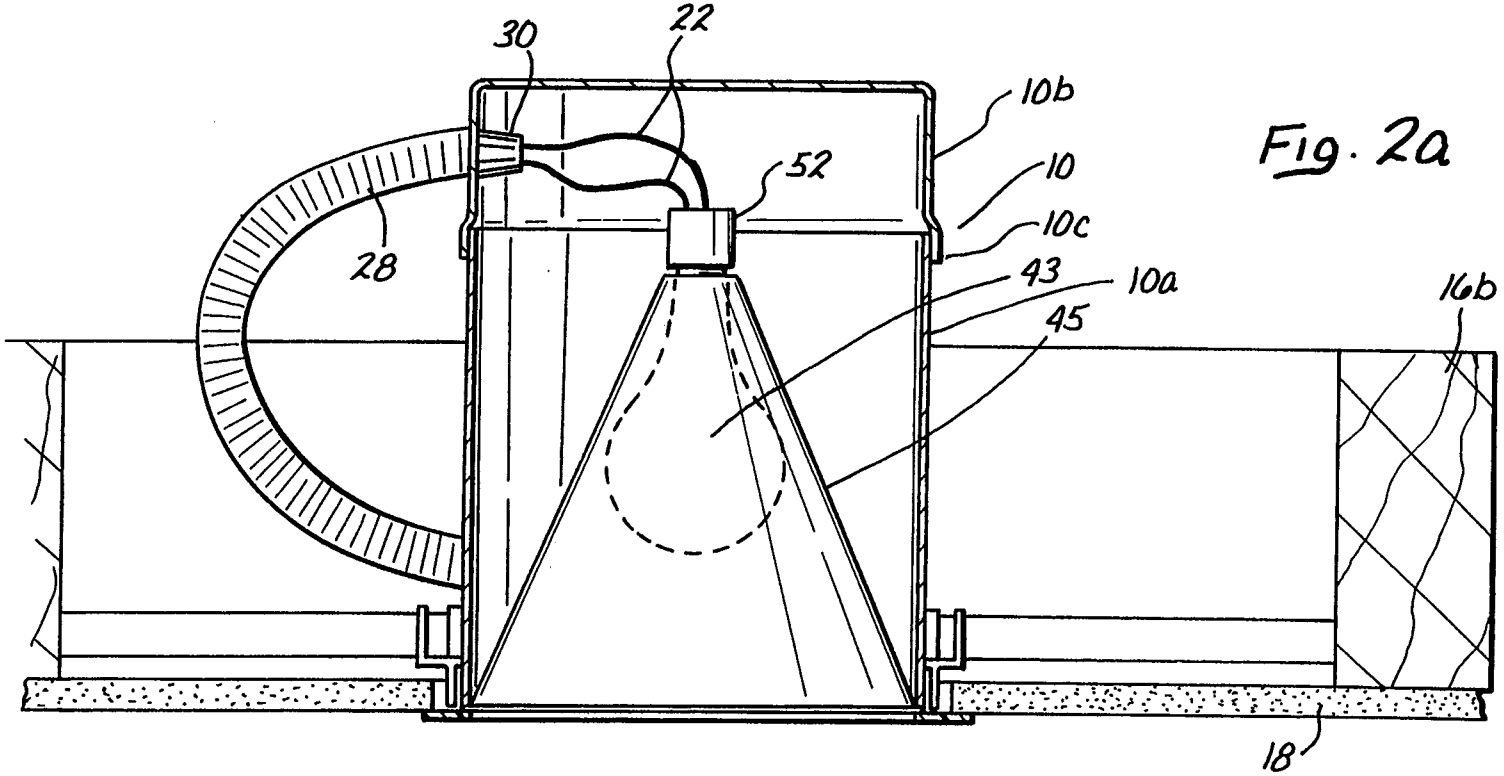
FIG. 2*a* is a side elevation partly in section showing a conventional incandescent lamp fixture installation in a housing of the type shown in the upper part of FIG. 1.
Figure 1A:
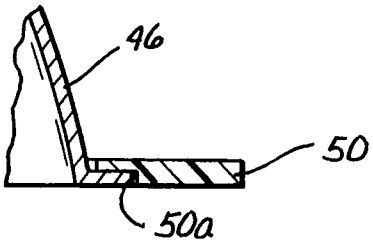
Figure 2B:
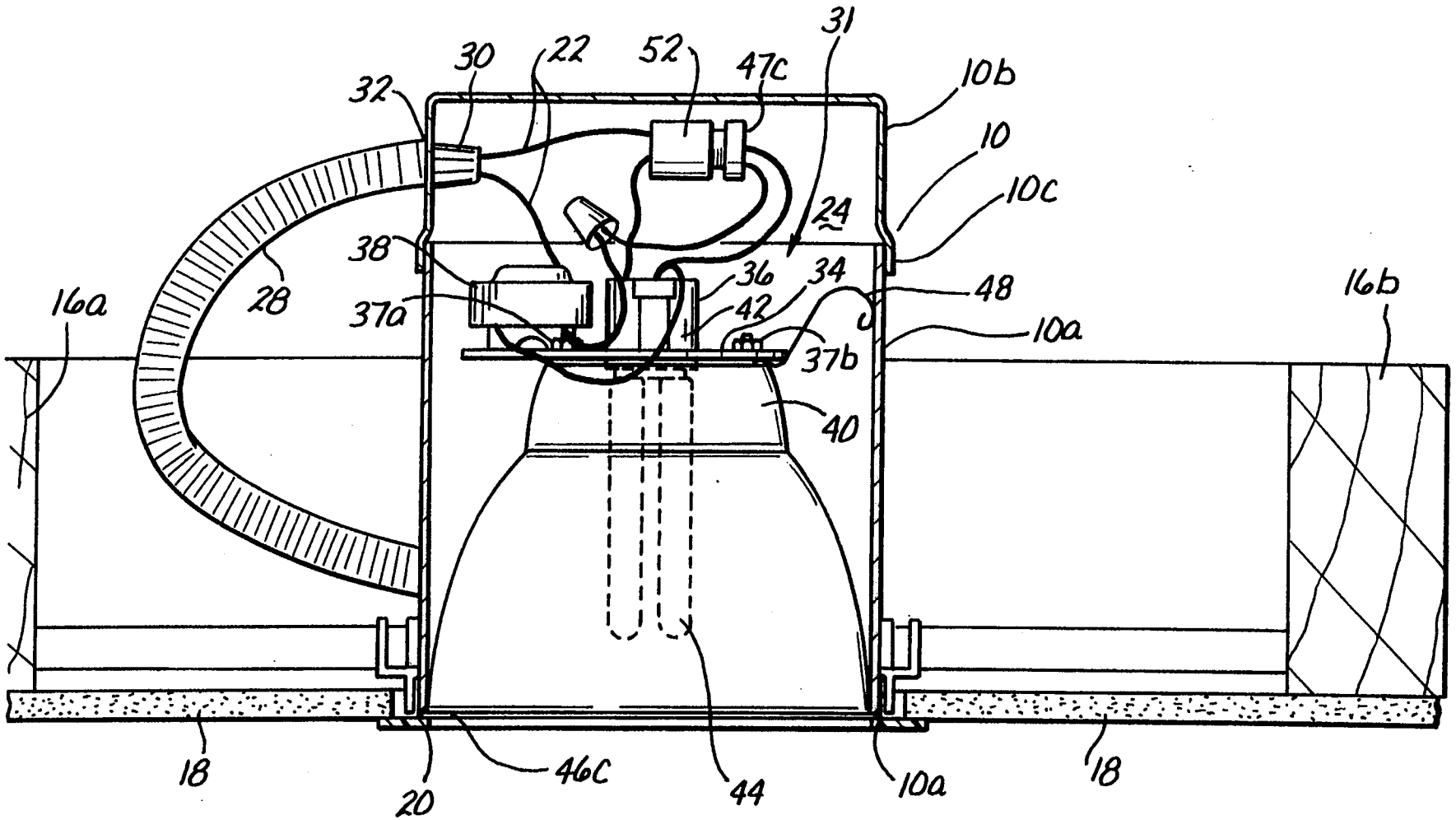
FIG. 2*b* is a side elevation partly in section showing the fixture of the present invention when substituted for the incandescent lamp fixture installation in the housing shown in FIG. 2*a*.

In assembling the fixture before the reflector housing 46 is mounted on the underside of the plate 34, the ring 50 will be slipped down over the sections 46*a* and 46*b* to where the recess 50*a* and the ring 50 receive the flange 46*c*.

Where it is desired to replace an incandescent lamp 43 and its reflector housing 45 as shown in FIG. 2*a* with the florescent light assembly 31 shown in FIGS. 1 and 2*b*, the lamp 43 is unscrewed from the socket 52 and the reflector housing 45 is removed from the outer housing 10. With the components of the present invention having been put together as an assembly 31 shown in lower part of FIG. 1, the plug 47*c* is first screwed into the socket 52 and the entire assembly 31, comprising the plate 34 with the reflector 46 mounted on its underside and the transformer 38 and florescent light socket 36 mounted on the top side of the plate 34, are pushed axially into the housing 10 to where the lower edge of the reflector 46*c* and its encircling ring 50 are disposed almost flushly in the opening 20 in the ceiling tiles 18, there to be held in place by the spring clips 48. The florescent lamp 44 may then be inserted into the socket 42 if they were not previously so inserted before the assembly 31 was pushed up into the housing 10 as above described.

In the event that it should become necessary to replace a lamp 44, the latter may be pulled out of the receptacle 36 and a replacement lamp inserted back in the receptacle 36. However, should it be necessary to replace the transformer 38, the entire fixture assembly 31 may be pulled out of the housing by the yielding of the spring clips 48 to the point where transformer and other items, including the wiring, plugs, etc. may be examined, replaced, or rewired.

The present invention, therefore, provides a very simple assembly which could be in the form of kit to replace or retrofit recessed lighting fixtures with incandescent light bulbs, with energy and cost saving florescent lighting.

I claim:

1. For insertion into a cylindrical housing for a lamp, said housing being secured in a circular ceiling opening, said housing having a side wall defining a cylindrical space and having an open lower end disposed in a common transverse plane and an upper closed end, said housing further having a first inside diameter and said housing having an aperture near its upper closed end to permit insulated electrical power wiring to be passed through the side wall adjacent the closed upper end of the side wall and extended to electrical connector means;

a florescent lamp holding fixture, said fixture comprising an insulated plate disposed transversely within the cylindrical space intermediate the upper closed end and open lower end of the side wall, but more proximate to the said upper closed end, said plate having a maximum linear dimension less than the first inside diameter of the housing;

a plurality of spring clip means secured to and extending transversely outwardly from said plate to provide a combined overall dimension of said plate and each of said clip means at least slightly greater than said first inside diameter of the housing, whereby said plate, when inserted axially into said housing, may be suspendedly retained transversely within the housing by said clip means;

said plate having a first side facing the closed end of the side wall and a second side facing the open lower end of said side wall, said plate supporting on its first side a socket for a florescent lamp and a transformer and conductive means to form a circuit between the transformer and said socket and to connect said circuit through said power wiring to said electrical connector means, and said plate being orificed in alignment with said socket to enable a florescent lamp to be inserted into said socket from the second side of said plate, whereby, the florescent lamp will extend downwardly toward the open lower end of said side wall;

and a reflector housing having a lower open end of a diameter only slightly less than said first inside diameter of the housing, and said reflector housing having an upper open end with a second diameter substantially less than the first inside diameter and the upper open end of said reflector housing being disposed about the orifice in alignment with the lamp socket in the plate and secured to the plate, said reflector housing having an increasing diameter from its upper open end to its lower open end, and said reflector housing having an axial length with the lower open end which terminates with the common transverse plane of the open lower end of the wall.

2. The fixture as described in claim 1, wherein a trim ring is provided, said trim ring having an outer edge with an outside diameter greater than a diameter of the circular ceiling opening, and an inner edge with an inside diameter less than the diameter of the open lower end of the reflector housing, said ring further having an upper face and a lower face, the lower face having an annular recess extending outwardly from the inner edge, and the lower open end of the reflector housing is formed with a small outwardly extending flange to seat in the annular recess of the trim ring.

* * * * *